United States Patent [19]

Hiraide

[11] Patent Number: 4,842,567

[45] Date of Patent: Jun. 27, 1989

[54] SPIRAL-SPRING TYPE DRIVING UNIT

[76] Inventor: Hideyuki Hiraide, 29-10, Kamakura 2-chome, Katsushika-ku, Tokyo, Japan

[21] Appl. No.: 108,246

[22] Filed: Oct. 14, 1987

Related U.S. Application Data

[63] Continuation-in-part of Ser. No. 29,346, Mar. 20, 1987, abandoned, which is a continuation of Ser. No. 758,191, Oct. 7, 1985, abandoned.

[30] Foreign Application Priority Data

Apr. 5, 1985 [JP] Japan ..... 60-50821
Apr. 6, 1985 [JP] Japan ..... 60-51261

[51] Int. Cl.[4] ..... A63H 17/00; A63H 29/24; F03G 1/08

[52] U.S. Cl. ..... 446/464; 185/39; 185/DIG. 1

[58] Field of Search ..... 446/464, 462, 461, 457; 185/39, 37, DIG. 1, 38

[56] References Cited

U.S. PATENT DOCUMENTS 4,463,831 8/1984 Wakase ..... 446/464 X
4,469,197 9/1984 Minoru ..... 446/464 X
4,582,171 8/1986 Jezierski ..... 446/464 X

*Primary Examiner*—Mickey Yu
*Attorney, Agent, or Firm*—Armstrong, Nikaido, Marmelstein, Kubovcik & Murray

[57] ABSTRACT

A spiral-spring type driving unit is disclosed, including a gear train formed essentially of a gear housing, three rotary shafts and six gears; and a spiral spring serves as a prime mover of a toy vehicle. The spiral spring of the driving unit is wound up so as to store a sufficient energy therein when the toy vehicle is moved backward by a relatively short distance by an external force. The toy vehicle can move forward by a relatively long distance under the influence of a resilient force of the thus tightened spiral spring when the spiral spring is unwound. The winding-up operation of the spiral spring is conducted by the means of a ring-like external gear serving as an idle gear in the gear train of the driving unit.

3 Claims, 3 Drawing Sheets

SPIRAL-SPRING TYPE DRIVING UNITy

This application is a continuation-in-part application of application Ser. No. 029,346, filed Mar. 20, 1987, abandoned; which was a continuation application of application Ser. No. 785,191, filed Oct. 7, 1985, abandoned.

BACKGROUND OF THE INVENTION

1. Field of the Invention

The present invention relates to a spiral-spring driving unit for use with a toy vehicle, and more particularly to a spiral-spring type driving unit employed in a toy vehicle which causes the spiral-spring type driving unit to store a sufficient energy therein when being moved backward by a relatively short disease, the thus stored energy being released to rotatably drive a driving axle of the toy vehicle so as to make it possible that the toy vehicle travels a relatively long distance.

2. Description of the Prior Art

In this spiral-spring type of driving unit, in order to ensure a relatively long travel distance for the toy vehicle in case that the toy vehicle is moved backward by a relatively short distance for storing energy therein, an input gear train of the driving unit differs from an output gear train of the same unit in gear ratio. Consequently, in any of conventional driving units, there are provided a pair of idle gears so as to provide an independent input and an independent output gear trains, which makes the driving unit complex in construction. However, it is preferable for the driving unit to be as small a size and as simple a construction as possible for use wth the toy vehicle, provided that the driving unit is sufficiently high in efficiency. Under such circumstances, there is a strong demand for developing such small-sized and simple construction driving unit with a high efficiency for use of the toy vehicle.

Hitherto, although many types of such driving units have been proposed, any of them is too complex in construction.

For example, U.S. Pat. No. 4,463,831 discloses one of such driving units, which is provided with a pair of idle gears fixedly mounted on rotary shafts which are supported by oblong bearing holes provided in three supporting plates, respectively. As described above, since the driving unit disclosed in the above U.S. Pat. employs such pair of idle gears, it is necessary for the driving unit to employ at least three supporting plates for defining a pair of gear housings, through which supporting plates are rotatably and swingably supported a pair of rotary shafts of the idle gears. As a result, it is necessary for the driving unit to employ at least five gears and five rotary shafts thereof in total, which makes the driving unit complex in construction.

In addition, in the driving unit disclosed in the above U.S. Patent, it is hard to wind up the spring of the driving unit in a condition in which the driving unit is turned upside down.

SUMMARY OF THE INVENTION

It is an object of the present invention to provide a spiral-spring type driving unit for use with a toy vehicle, in which driving unit a ring-like centreless external gear serves as an idle gear which is swung and rotatably driven in a winding-up operation of a spiral spring of the driving unit, in which winding-up operation the toy vehicle employing the driving unit is moved backward by a relatively short distance to store a sufficient energy in the spring of the driving unit thereof so as to make it possible that the toy vehicle travels a relatively long distance.

The ring-like centreless external gear of the driving unit of the present invention is rotatably and swingably supported by an inner peripheral surface of a gear housing of the driving unit, which inner peripheral surface of the gear housing permits the ring-like centreless external gear to swingably move between a first position in which the ring-like centreless external gear meshes with other gears during the winding-up operation of the driving unit and a second position in which the ring-like centreless external gear is disengaged from such other gears, and also permits the ring-like centreless external gear to rotate in these first and second positions. Such peripheral surface of the gear housing is preferably provided with at least one opening permitting the ring-like centreless external gear to engages with such other gears.

Swingable movement of the ring-like centreless external gear of the driving unit is limited by a suitable means, for example such as extensions of the inner peripheral surface of the gear housing and/or a protrusion provided in a side surface of the gear housing, which protrusion is provided with an arc-shaped external surface which is brought into a slidable contact with a central bore of the ring-like centreless external gear during the winding-up operation of the spiral spring of the driving unit.

DESCRIPTION OF THE PREFERRED EMBODIMENT

Hereinbelow will be described an embodiment of the spiral-spring type driving unit of the present invention in detail with reference to the drawings. It is clear that the present invention is not limited to such embodiment only.

Figure 1:
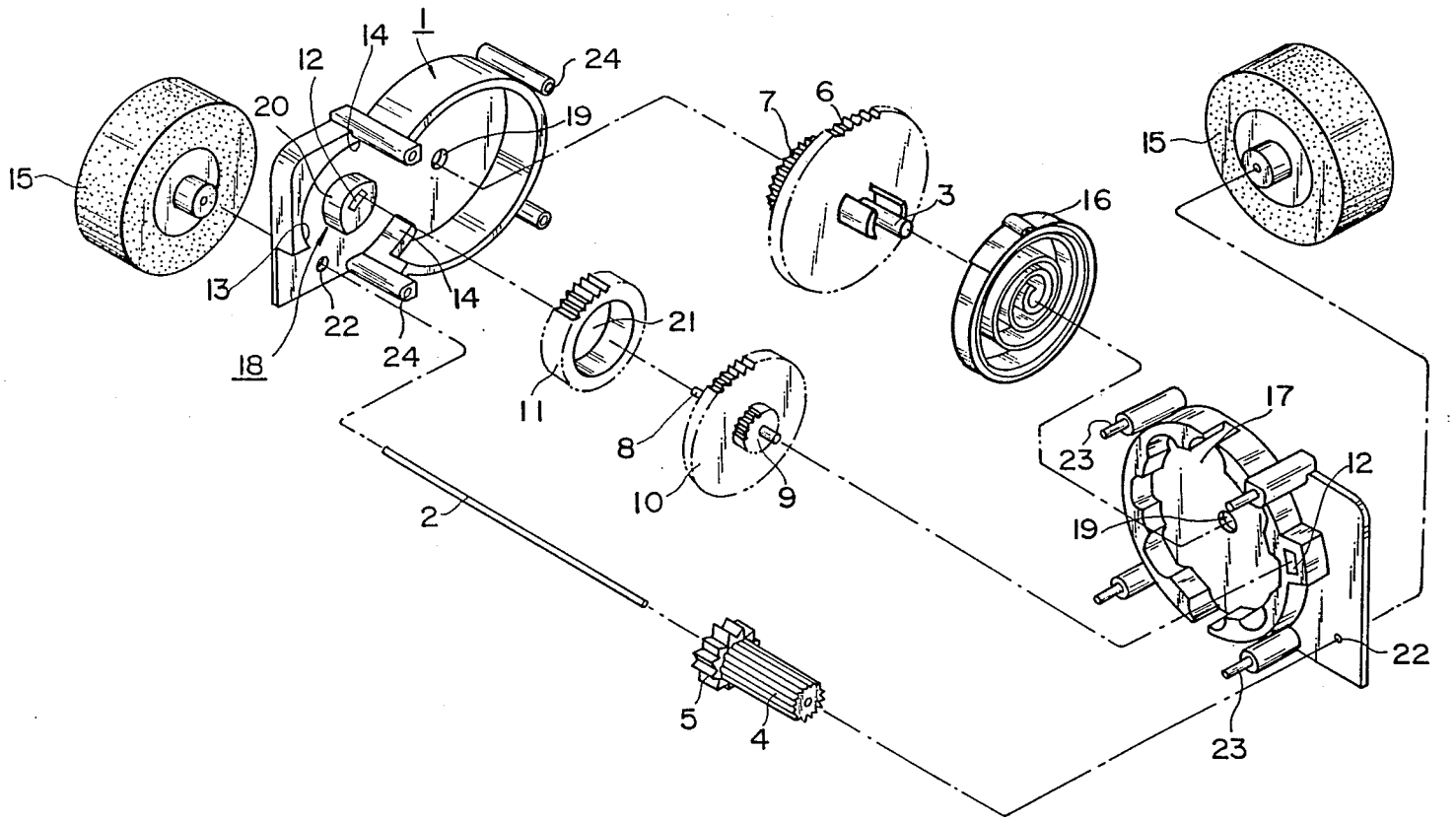
FIG. 1 is an exploded view of the spiral-spring type driving unit of the present invention.

As shown in FIG. 1, a gear housing 1 of the spiral-spring type driving unit of the present invention is constructed of a pair of molded housing halves made of polyacetal (POM), one of which halves is provided with a concave portion 17 for receiving a spiral spring 16 of the driving unit therein, and the other of which halves if provided with a recess for receiving a gear train of the driving unit therein.

The housing halves of the gear housing 1 are assembled into the housing 1 by means of four thin projections 23 provided in one of the housing halves and four holes provided in the other of the housing halves, which four holes correspond to the four thin projections and receive the sames therein.

The spiral spring 16 is mounted in the concave portion 17 of the half of the gear housing 1 while provided with a projection in its outer end, which projection is engaged with a recess of an inner surface of the concave portion 17 so as to be fixed thereto as is in a conventional case.

An inner end of the spiral spring 16 is fixedly mounted on a winding-up shaft 3 through which the spiral spring 16 is wound up to store energy therein and unwound to release the thus stored energy therefrom. A second transmission gear 6, which is integrally formed with the winding-up shaft 3 and a winding-up gear 7, is rotatably mounted in the gear housing 1 at a position adjacent to the spiral spring 16 so that the winding-up gear 7 locates in a position opposite to the spiral spring 16 with respect to the second transmission gear 6. The winding-up shaft 3 is rotatably supported in bearing holes 19 provided in the side walls of the gear housing 1. The second transmission gear 6, winding-up shaft 3 and the winding-up gear 7 are made of POM and may be separately molded.

A ring-like centreless external gear 11 is made of POM and serves as an idle gear which is supported by an inner peripheral surface 13 of the gear housing 1. The inner peripheral surface 13 assumes a form permitting the ring-like idle gear 11 to swingably and rotatably move around a driving axle 2 within a space defined by the inner peripheral surface 13 which is provided with two openings through which the ring-like idle gear 11 engages with the winding-up gear 7 and a first transmission gear 5. The inner peripheral surface 13 of the gear housing 1 limits a swinging movement of the ring-like idle gear 11 at positions in which the ring-like idle gear 11 engages with the winding-up gear 7 and the first transmission gear 5 so as to prevent the ring-like idle gear 11 from dropping out of the space defined by the inner peripheral surface 13 of the gear housing 1.

A protrusion 18 is provided in a side surface of the gear housing 1 for rotatably supporting the ring-like idle gear 11 in cooperation with the inner peripheral surface 13 of the gear housing 1.

The ring-like centreless idle gear 11 is mounted on the protrusion 18 within the space defined by the inner peripheral surface 13 of the gear housing 1.

An external peripheral surface 20 of the protrusion 18, which is brought into a slidable contact with a central bore of the ring-like centreless idle gear 11, assumes a substantially longitudinal sectional configuration of a football, i.e., a configuration formed of a pair of opposite arcs a diameter of each of which arcs is the same as that of the central bore of the ring-like centreless external gear 11.

Figure 3:
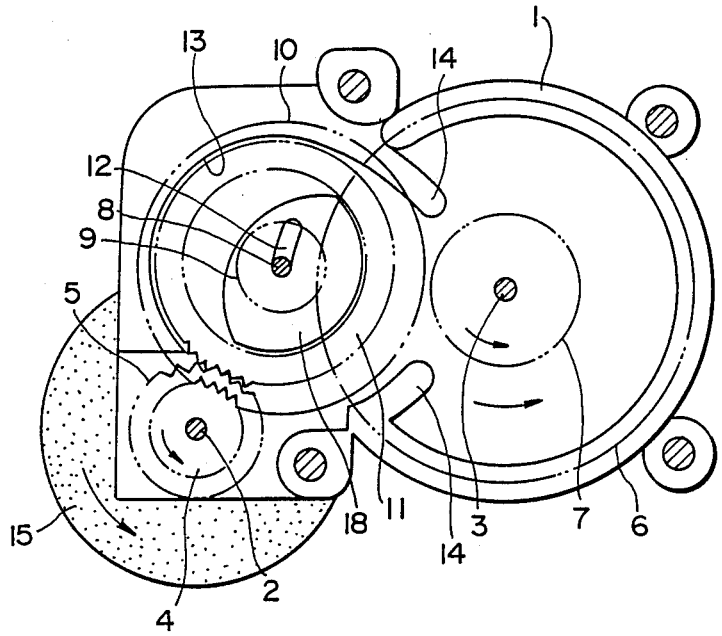
FIG. 3 is a schematic side view of the driving unit of the present invention in a condition in which the driving unit drives its driving axle.

During the winding-up operation of the spiral spring 16 of the driving unit, the ring-like idle gear 11 is engaged with the winding-up gear 7 and the first transmission gear 5 while slidably supported by one of a pair of external arc-shaped surfaces of the protrusion 18 and extensions 14 of the inner peripheral surface 13 of the gear housing, which extensions 14 extend toward the driving axle 3 of the driving unit as shown in FIG. 3. On the other hand, during an unwinding operation of the spiral spring 16 of the driving unit, the ring-like idle gear 11 if forced to disengage from from the winding-up gear 7 while slidably supported by the inner peripheral surface 13 and the other of the the pair of the external arc-shaped surfaces of the protrusion 18, whereby the ring-like idle gear 11 is prevented from dropping out of the space defined by the inner peripheral surface 13 of the gear housing 1.

Figure 2:
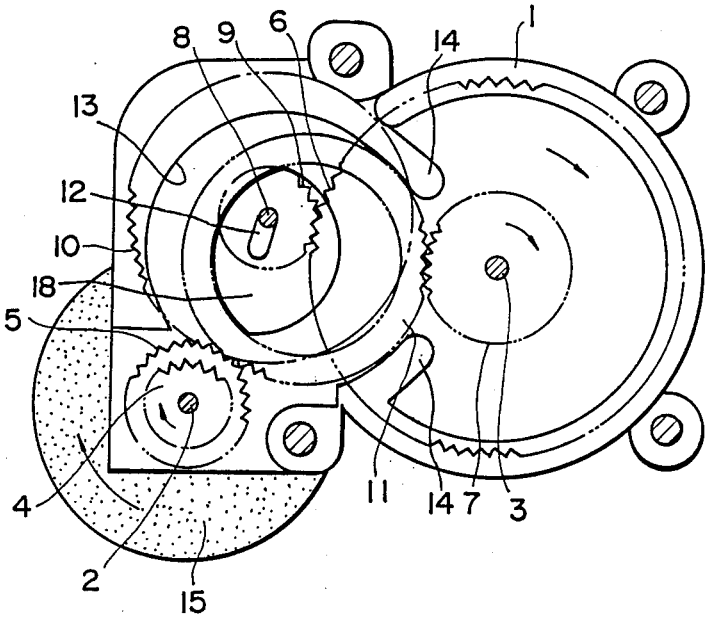
FIG. 2 is a schematic side view of the driving unit of the present invention in a condition in which the spiral spring of the driving unit is wound up.

As is clear from the above description, the central bore of the ring-like idle gear 11 is made smooth. As shown in FIG. 2, when the ring-like idle gear 11 engages with the winding-up gear 7, the central bore of the ring-like idle gear 11 is brought into a slidable contact with one of the pair of the arc-shaped surfaces 20 of the protrusion 18, which one is more spaced apart from the winding-up gear 7 than the other of the arc-shaped surfaces 20 of the protrusion 18, and also brought into a slidable contact with front portions of the extensions 14 of the inner peripheral surface 13 of the gear housing 3.

It is also possible to omit one of the protrusion 18 and the inner peripheral surface 13 of the gear housing 1.

An elongated bearing hole 12 is provided in the protrusion 18, which hole 12 corresponds to another elongated bearing hole 12 provided in the side surface of the gear housing 1 as shown in FIG. 1. These elongated bearing holes 12 assume arc-shaped forms or segments of a circle a center of which is formed by a bearing hole 19 for receiving the winding-up shaft 3. In this case, the elongated bearing hole 12 is not limited in length.

The gear housing 1 is further providing with a pair of bearing holes 22 which rotatably receive the driving axle 2 therein.

In order to make the driving unit of the present invention compact, these bearing holes 12, 19, 22 are preferably so arranged that they form a triangle. However, if necessary, it is also possible to align these bearing holes 12, 19, 22 in arrangement. In addition, the driving axle 2 is disposed to be parallel to the winding-up shaft 3.

A movable shaft 8 is rotatably supported by the elongated bearing holes 12, on which movable shaft 8 are fixedly and coaxially mounted a spur gear 10 and a pinion gear 9 which is adjacent to the spur gear 10 in a position opposite to the spiral spring 16. The movable shaft 8 is integrally formed with the spur gear 10 and the pinion gear 9 while preferably made of POM. The movable shaft 8, spur gear 10 and the pinion gear 9 may be separately formed and assembled into a single member.

The driving axle 2 is rotatably supported in the bearing holes 22. On the driving axle 2 are fixedly and coaxially mounted the first transmission gear 5 in a position opposite to the protrusion 18 and a driving gear 4 adjacent to the first transmission gear 5 as shown in FIG. 1. The driving gear 4 is integrally formed with the first transmission gear 5 while preferably made of POM. The driving axle 2 is made of metal while provided with driving wheels 15 at its opposite ends. Preferably, the driving axle 2 is integrally formed with the driving gear 4 and the first transmission gear 5.

In the winding-up operation of the spiral spring 16 of the driving unit for storing a sufficient energy therein, the driving axle 2 is first rotated, a torque produced in which driving axle 2 is transmitted to the winding-up shaft 3 through the first transmission gear 5, ring-like external idle gear 11, and the winding-up gear 7. In this case, an input gear ratio of the driving gear 4 to the winding-up gear 7 is 1 to 1.4. Theoretically, in the winding-up operation of the driving unit, it is preferable to employ a large input gear ratio. However, due to restrictions in construction, the input gear ratio of the driving unit is practically within a range of from 1:1 to 1:2.

In the unwinding operation of the spiral spring 16 of the driving unit for moving the toy vehicle forward, a torque produced in the winding-up shaft 3 is transmitted to the driving axle 2 through the second transmission gear 6, pinion gear 9, spur gear 10 and the driving gear 4. In this case, an output gear ratio of the second transmission gear 6 to the driving gear 4 is 1 to 23. It is also possible to employ another output gear ratio different from the above output gear ratio in the driving unit of the present invention.

In this embodiment of the driving unit of the present invention, although the driving wheels 15 are mounted on the driving axle 2, it is also possible to mount other suitable driving means on the driving axle 2.

Each of components of the driving unit of the present invention may be made of conventional materials.

Hitherto, the ring-like centreless idle gear 11 has not been proposed in any field of the arts.

In the spiral-spring type driving unit of the present invention is employed a quite novel idle gear which is the ring-like centreless external gear 11 and makes it possible to eliminate at least one shaft and one gear in comparison with the simplest conventional driving unit. In addition, without impairing the driving unit in its strength and efficiency, the present invention makes it possible that the gear housing 1 is constructed of two plates or housing halves, which is a drastic improvement in compaction of the driving unit.

In contrast with the conventional driving unit, it is possible to conduct any of the winding-up and unwinding operations of the driving unit of the present invention in an easy and smooth manner, even when the driving unit is turned upside down.

In the winding-up operation of the spiral spring 16 of the driving unit for storing a sufficient energy therein, as shown in FIG. 2, when the driving wheel 15 is rotated clockwise, the first transmission gear 5 is rotated clockwise together with the driving wheel 15. Since the first transmission gear 5 engages with the ring-like external idle gear 11, the latter 11 is rotated counterclockwise so that the ring-like idle gear 11 comes to an engagement with the winding-up gear 7 to cause the same 7 to rotate clockwise, whereby the winding-up shaft 3 is rotated clockwise together with the winding-up gear 7 to wind up the spiral spring 16 so as to store a sufficient energy therein. So long as the ring-like external idle gear 11 rotates, the idler gear 11 is kept in engagements with the first transmission gear 5 and the winding-up gear 7.

The pinion gear 9 is always engaged with the second transmission gear 6. However, in the winding-up operation of the spiral spring 16, the pinion gear 9 is swung upward together with the winding-up shaft 3 by means of the second transmission gear 6 while engaged with the same 6 as shown in FIG. 2. As a result, the spur gear 10 is disengaged from the driving gear 4.

During this winding-up operation, the ring-like external idle gear 11 is rotatably supported by the external arc-shaped surface of the protrusion 18 and the the extensions 14 of the inner peripheral surface 13 of the gear housing 1.

In the unwinding operation of the spiral spring 16 of the driving unit for moving the toy vehicle forward, as shown in FIG. 3, the winding-up shaft 3 is rotated counterclockwise under the effect of a resilient force of the tightened spiral spring 16 so that the second transmission gear 6 is rotated counterclockwise together witht the winding-up shaft 3. Since the second transmission gear 6 engages with the pinion gear 9, the latter 9 is rotated clockwise.

Since the pinion gear 9 is rotated clockwise, the movable shaft 8 on which the pinion gear 9 is fixedly mounted is moved downward so that the spur gear 10 comes in an engagement with the driving gear 4 as shown in FIG. 3, whereby the driving axle 2 on which the driving gear 4 is fixedly mounted is rotated clockwise together with the driving gear 4.

At this time, the ring-like external idle gear 11 is rotated counterclockwise in a condition shown in FIG. 3, so as to move upward toward the left-hand side of FIG. 3, whereby the ring-like external idle gear 11 is disengaged from both the winding-up gear 7 and the first transmission gear 5 while prevented from dropping out of the space defined by the inner peripheral surface 13 of the gear housing 1, by means of such inner peripheral surface 13 and the protrusion 18 provided in the side surface of the gear housing 1.

What is claimed is:

1. In a spiral-spring type driving unit having a gear housing mounted in a toy wheeled-vehicle to drive the wheels of said vehicle, said toy vehicle being moved backwards for a relatively short distance by an external force to wind up the spiral-spring and store sufficient energy therein so that during its moving operation the energy in said spiral-spring will operate said driving unit to drive the wheels of said toy vehicle and propel it for a relatively long distance, the improvement wherein in ring-like centerless external gear is used as a meshing gear to mesh with other gears of said driving unit during winding up of the spiral-spring, and means to swingably and rotatably support said ring-like centerless external gear in said driving unit during the winding of said spiral-spring to unmesh said ring-like centerless external gear to allow driving of the wheels of said toy vehicle and propel the toy vehicle forwardly.

2. The spiral-spring type driving unit as set forth in claim 1, wherein: said means for swingably and rotatably supporting said ring-like centerless external gear includes an inner peripheral surface of said clear housing adjacent to a side surface of said gear housing, said inner peripheral surface permitting said ring-like centerless external gear to move between a first position in which said ring-like centerless external gear engages with other gears during said winding-up operation of said spiral spring and a second position in which said ring-like centerless external gear is disengaged from said other gears during said unwinding operation of said tightened spiral spring, in which first and second positions said ring-like centerless external gear is rotatably supported, said inner peripheral surface being provided with at least one opening for permitting said ring-like centerless external gear to engage with said other gears.

3. The spiral-spring type driving unit as set forth in claim 1, wherein: said means for swingably and rotatably supporting said ring-like centerless external gear includes a protrusion provided in a side surface of said gear housing, said protrusion being provided with an arc-shaped surface having a radius of curvature which is the same as that of a central bore of said ring-like centerless external gear to permit said ring-like centerless external gear to be slidably supported by said arc-shaped surface of said protrusion during said winding-up operation in which said ring-like centerless external gear comes to engagement with said other gears.

* * * * *